US009155136B2

(12) United States Patent
Liang et al.

(10) Patent No.: US 9,155,136 B2
(45) Date of Patent: Oct. 6, 2015

(54) LED DRIVER HAVING COMPENSATION CAPACITOR SET

(71) Applicant: National Cheng Kung University, Tainan (TW)

(72) Inventors: Tsorng-Juu Liang, Tainan (TW); Wei-Jing Tseng, Tainan (TW); Jiann-Fuh Chen, Tainan (TW)

(73) Assignee: NATIONAL CHENG KUNG UNIVERSITY (TW)

( * ) Notice: Subject to any disclaimer, the term of this patent is extended or adjusted under 35 U.S.C. 154(b) by 192 days.

(21) Appl. No.: 13/965,656

(22) Filed: Aug. 13, 2013

(65) Prior Publication Data

US 2014/0049171 A1 Feb. 20, 2014

(30) Foreign Application Priority Data

Aug. 14, 2012 (TW) ..... 101129435 A

(51) Int. Cl.
*H05B 33/08* (2006.01)

(52) U.S. Cl.
CPC ..... *H05B 33/0806* (2013.01); *H05B 33/0809* (2013.01); *H05B 33/0824* (2013.01)

(58) Field of Classification Search
USPC ..... 315/187, 228
See application file for complete search history.

(56) References Cited

U.S. PATENT DOCUMENTS

| | | | | |
|---|---|---|---|---|
| 2005/0057179 | A1* | 3/2005 | Madhani et al. | 315/185 R |
| 2012/0161650 | A1* | 6/2012 | Liang et al. | 315/188 |
| 2012/0262075 | A1* | 10/2012 | Lynch et al. | 315/192 |
| 2014/0049171 | A1* | 2/2014 | Liang et al. | 315/187 |
| 2014/0265898 | A1* | 9/2014 | Del Carmen et al. | 315/200 R |
| 2015/0002035 | A1* | 1/2015 | Schie et al. | 315/200 R |
| 2015/0061523 | A1* | 3/2015 | Chen | 315/200 R |

* cited by examiner

*Primary Examiner* — Adam Houston
(74) *Attorney, Agent, or Firm* — Volpe and Koenig, P.C.

(57) ABSTRACT

Configurations for an LED driver are disclosed. The proposed LED driver receives an input voltage, drives an LED and includes a compensation capacitor set including a first and a second capacitors connected to each other in series, wherein the first capacitor is electrically connected to the LED, the second capacitor is grounded, the compensation capacitor set provides a compensation voltage to the LED such that the LED is conductible when an instantaneous voltage value of the input voltage is lower than an LED conduction voltage.

12 Claims, 9 Drawing Sheets

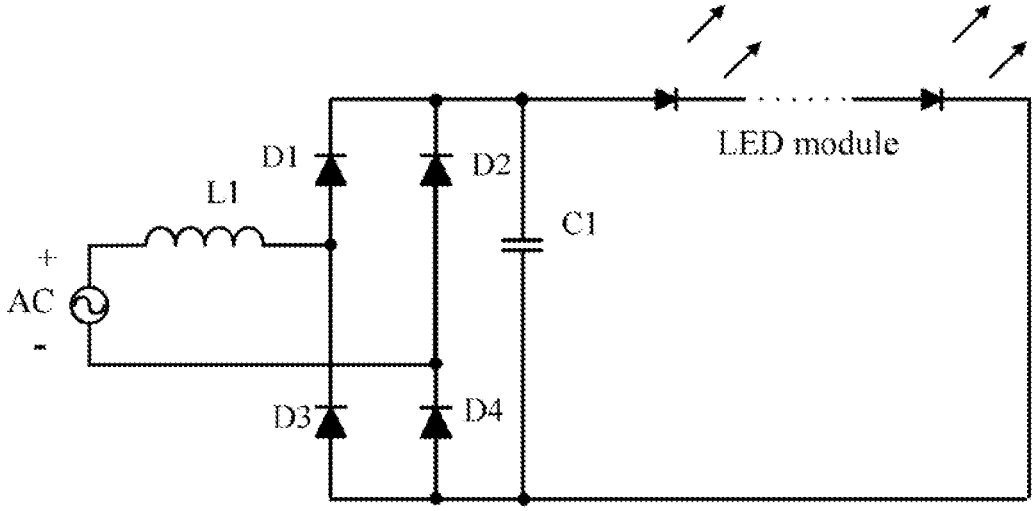
Fig. 1(Proir Art)
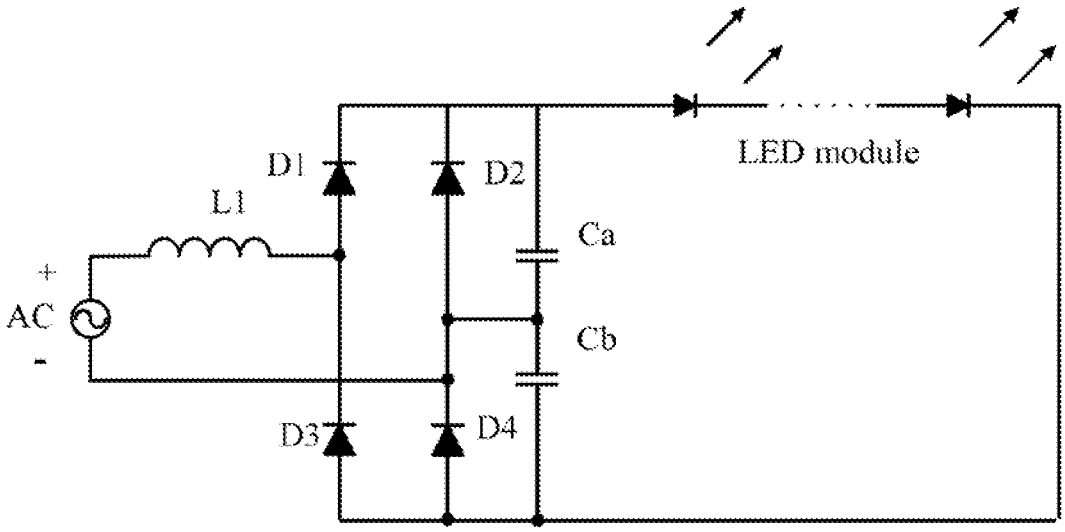
Fig. 2

LED DRIVER HAVING COMPENSATION CAPACITOR SET

CROSS REFERENCE TO RELATED APPLICATION

The application claims the benefits of Taiwan Patent Application Number 101129435 filed on Aug. 14, 2012, at the Taiwan Intellectual Property Office, the disclosures of which are incorporated herein in their entirety by reference.

FIELD OF INVENTION

The present invention relates to a passive light-emitting diode (LED) driver, in particular to an LED driver having a compensation capacitor set.

BACKGROUND

LEDs, in contrast to the traditional illumination lamps, e.g. the incandescent lamp, have the advantages of comparatively saving electricity and having a longer life-span, and are thus increasingly widely used as the illumination lamps. A circuit diagram of a traditional LED driver having a filter circuit is shown in FIG. 1. In FIG. 1, the driver includes an AC input power source AC, a bridge rectifier having rectifying diodes D1-D4, a filter circuit having an inductor L1 and a capacitor C1 and an LED module.

The traditional LED driver having the filter circuit as shown in FIG. 1 has a relatively lower power factor (PF), a relatively larger total harmonic distortion (THD) and a relatively lower efficiency. Thus, developing a method to improve the traditional LED driver to make it have a relatively higher PF, a relatively lower THD and a relatively higher efficiency to further save energy and exhibit maximum effectiveness is worthy of further research and improvement.

Keeping the drawbacks of the prior arts in mind, and employing experiments and research heartily and persistently, the applicant has finally conceived an LED driver having a compensation capacitor set.

SUMMARY

It is therefore an objective of the present invention to disclose an LED driver having a relatively higher PF, a relatively lower THD and a relatively higher efficiency to further save energy and exhibit maximum effectiveness.

In accordance with the first aspect of the present invention, a light emitting diode (LED) driver receives an input voltage, drives a first and a second LED modules, and includes a compensation capacitor set including a first and a second capacitors electrically connected to each other in series, wherein the first capacitor is electrically connected to the first and the second LED modules, the second capacitor is grounded, and the compensation capacitor set provides a compensation voltage to the first and the second LED modules when an instantaneous voltage value of the input voltage is lower than an LED conduction voltage such that the first and the second LED modules are conductible, an overvoltage protection and energy recovery circuit including an energy recovery circuit including a third capacitor having a first and a second terminals, and a first diode having an anode and a cathode, wherein the anode of the first diode is electrically connected to the first terminal of the third capacitor, the second terminal of the third capacitor is grounded, the cathode of the first diode is electrically connected to the first and the second LED modules, and a stored energy in the third capacitor is released to the first and the second LED modules when a cross voltage between the first and the second terminals of the third capacitor is larger than a cross voltage of the compensation capacitor set, and a segmental current-limiting circuit including a first voltage divider electrically connected to the compensation capacitor set in parallel and having a first midpoint, a first current limiting circuit including a second diode having an anode and a cathode, a first resistor having a first and a second terminals, wherein the first terminal of the first resistor is electrically connected to the anode of the second diode, and the second terminal of the first resistor is grounded, a first transistor having a first terminal, a second terminal and a control terminal, wherein the first terminal of the first transistor is electrically connected to the first and the second LED modules, the second terminal of the first transistor is electrically connected to the first terminal of the first resistor, and the control terminal of the first transistor is electrically connected to the first midpoint of the first voltage divider, and a second transistor having a first terminal, a second terminal and a control terminal, wherein the first terminal of the second transistor is electrically connected to the second terminal of the first transistor, the second terminal of the second transistor is grounded, and the control terminal of the second transistor is electrically connected to the cathode of the second diode, and an input voltage detection circuit electrically connected to the compensation capacitor set in parallel and including a second midpoint electrically connected to the control terminal of the second transistor, wherein the second midpoint has a voltage value used to determine whether the LED driver enters a segmental conduction mode.

In accordance with the second aspect of the present invention, a light emitting diode (LED) driver receives an input voltage, drives a first and a second LED modules, and includes a compensation capacitor set including a first and a second capacitors electrically connected to each other in series, wherein the first capacitor is electrically connected to the first and the second LED modules, the second capacitor is grounded, and the compensation capacitor set provides a compensation voltage to the first and the second LED modules when an instantaneous voltage value of the input voltage is lower than an LED conduction voltage such that the first and the second LED modules are conductible, and a segmental current-limiting circuit including a voltage divider electrically connected to the compensation capacitor set in parallel and having a first midpoint, a current limiting circuit including a first diode having an anode and a cathode, a first resistor having a first and a second terminals, wherein the first terminal of the first resistor is electrically connected to the anode of the first diode, and the second terminal of the first resistor is grounded, a first transistor having a first terminal, a second terminal and a control terminal, wherein the first terminal of the first transistor is electrically connected to the first and the second LED modules, the second terminal of the first transistor is electrically connected to the first terminal of the first resistor, and the control terminal of the first transistor is electrically connected to the first midpoint of the voltage divider, and a second transistor having a first terminal, a second terminal and a control terminal, wherein the first terminal of the second transistor is electrically connected to the second terminal of the first transistor, the second terminal of the second transistor is grounded, and the control terminal of the second transistor is electrically connected to the cathode of the first diode, and an input voltage detection circuit electrically connected to the compensation capacitor set in parallel and including a second midpoint, wherein the second midpoint is electrically connected to the control terminal of the second transistor, and a voltage value of the second midpoint is used to determine whether the LED driver switches into an overvoltage protection mode.

In accordance with the third aspect of the present invention, a light emitting diode (LED) driver receives an input voltage, drives an LED, and includes a compensation capacitor set including a first and a second capacitors electrically connected to each other in series, wherein the first capacitor is electrically connected to the LED, the second capacitor is grounded, and the compensation capacitor set provides a compensation voltage to the LED when an instantaneous voltage value of the input voltage is lower than an LED conduction voltage such that the LED is conductible.

BRIEF DESCRIPTION OF THE DRAWINGS

Other objectives, advantages and efficacy of the present invention will be described in detail below taken from the preferred embodiments with reference to the accompanying drawings, in which:

FIG. 1 is a circuit diagram of a traditional LED driver having a filter circuit.

FIG. 2 is a circuit diagram of an LED driver having a compensation capacitor set according to the first preferred embodiment of the present invention.

FIG. 10(*b*) shows the waveform diagram of the input current and the input voltage versus time when the input voltage is too high of the LED driver having a compensation capacitor set according to the fourth preferred embodiment of the present invention as shown in FIG. 9.

DETAILED DESCRIPTION OF THE PREFERRED EMBODIMENTS

The present invention will now be described more specifically with reference to the following embodiments. It is to be noted that the following descriptions of preferred embodiments of this invention are presented herein for purposes of illustration and description only; it is not intended to be exhaustive or to be limited to the precise form disclosed.

The present invention discloses a passive LED driver without using any active element but still achieving the features of having the relatively higher PF, the relatively lower THD and the relatively higher efficiency. FIG. 2 is a circuit diagram of an LED driver having a compensation capacitor set according to the first preferred embodiment of the present invention. In FIG. 2, it includes an AC power source AC, a bridge rectifier having rectifying diodes D1-D4, an LED module having a plurality of LEDs, a compensation capacitor set Ca+Cb and a filter inductor L1, wherein each of Ca and Cb is a compensation capacitor. The present invention employs the compensation capacitor set Ca+Cb to cause each of the plurality of LEDs of the LED module to be conductible when an instantaneous voltage value of the input voltage is lower than an LED conduction voltage so as to raise the system power factor, and to decrease the THD, and employs a filter inductor L1 to filter high order harmonics to increase the power factor. Using the techniques related to the present invention, the use of inductors and capacitors could be dramatically decreased.

Figure 3A:
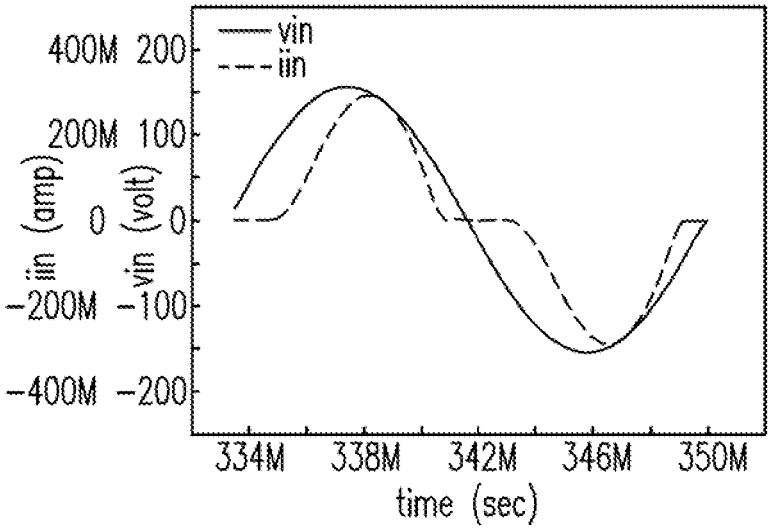
FIGS. 3(*a*) and 3(*b*) respectively show the waveform diagram of the input voltage and the input current versus time, and the waveform diagram of the current flowing through the LED module versus time of the traditional LED driver having the filter circuit as shown in FIG. 1.
Figure 3B:
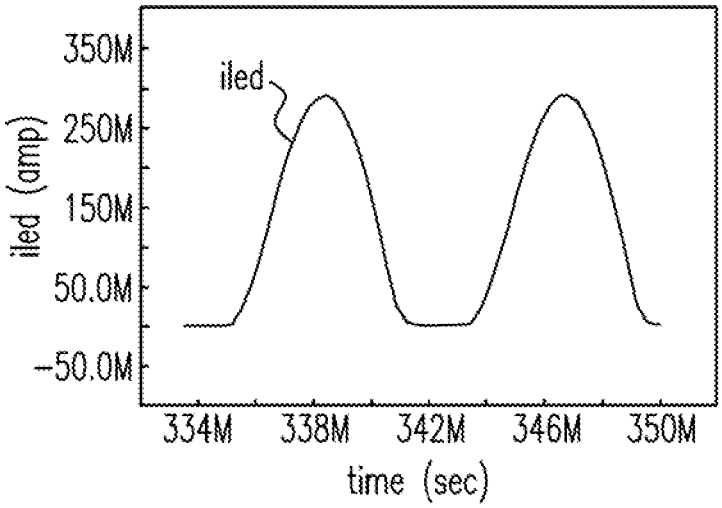
Figure 4A:
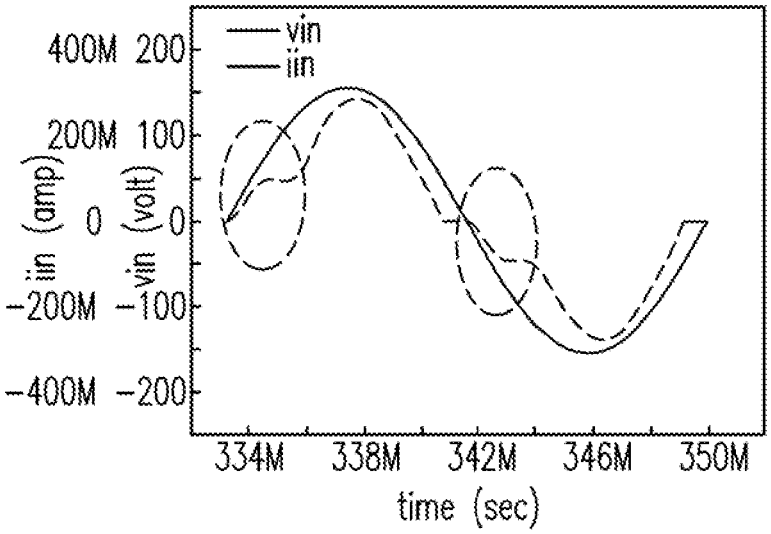
FIGS. 4(*a*) and 4(*b*) respectively show the waveform diagram of the input voltage and the input current versus time, and the waveform diagram of the current flowing through the LED module versus time of the LED driver having a compensation capacitor set according to the first preferred embodiment of the present invention as shown in FIG. 2.
Figure 4B:
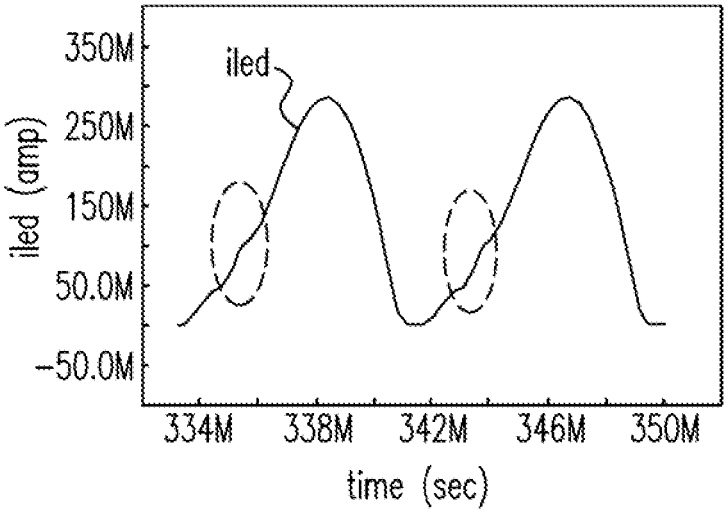

FIGS. 3(*a*) and 3(*b*) respectively show the waveform diagram of the input voltage vin (volt) and the input current iin (amp) versus time (sec), and the waveform diagram of the current flowing through the LED module iled (amp) versus time (sec) of the traditional LED driver having the filter circuit as shown in FIG. 1. FIGS. 4(*a*) and 4(*b*) respectively show the waveform diagram of the input voltage vin (volt) and the input current iin (amp) versus time (sec), and the waveform diagram of the current flowing through the LED module iled (amp) versus time (sec) of the LED driver having a compensation capacitor set Ca+Cb according to the first preferred embodiment of the present invention as shown in FIG. 2. The circled areas in FIGS. 4(*a*) and 4(*b*) indicate where the compensation capacitor Ca/Cb engages in mending the waveform. Under the same inductances and capacitances, the THD of the LED driver having a compensation set Ca+Cb according to the first preferred embodiment of the present invention as shown in FIG. 2, when compared with the THD of the traditional LED driver having the filter circuit as shown in FIG. 1, is 10% less, and the power factor of which is 10% more. For example, to engage in a test using the same inductance L1=0.4H, C1=Ca+Cb=1 μF, in FIG. 2, the THD=20% and PF=0.96, and in FIG. 1, the THD=30% and PF=0.82. Because the filter circuits all operate at a low frequency (the commercial power), the physical size of which are relatively larger and more expensive. If the driver having a compensation set Ca+Cb according to the first preferred embodiment of the present invention as shown in FIG. 2 is used, it has comparatively smaller inductances and capacitances, which achieves better effects, and has enormous superiority regarding the physical size and the prices of the needed inductors and capacitors.

Figure 5:
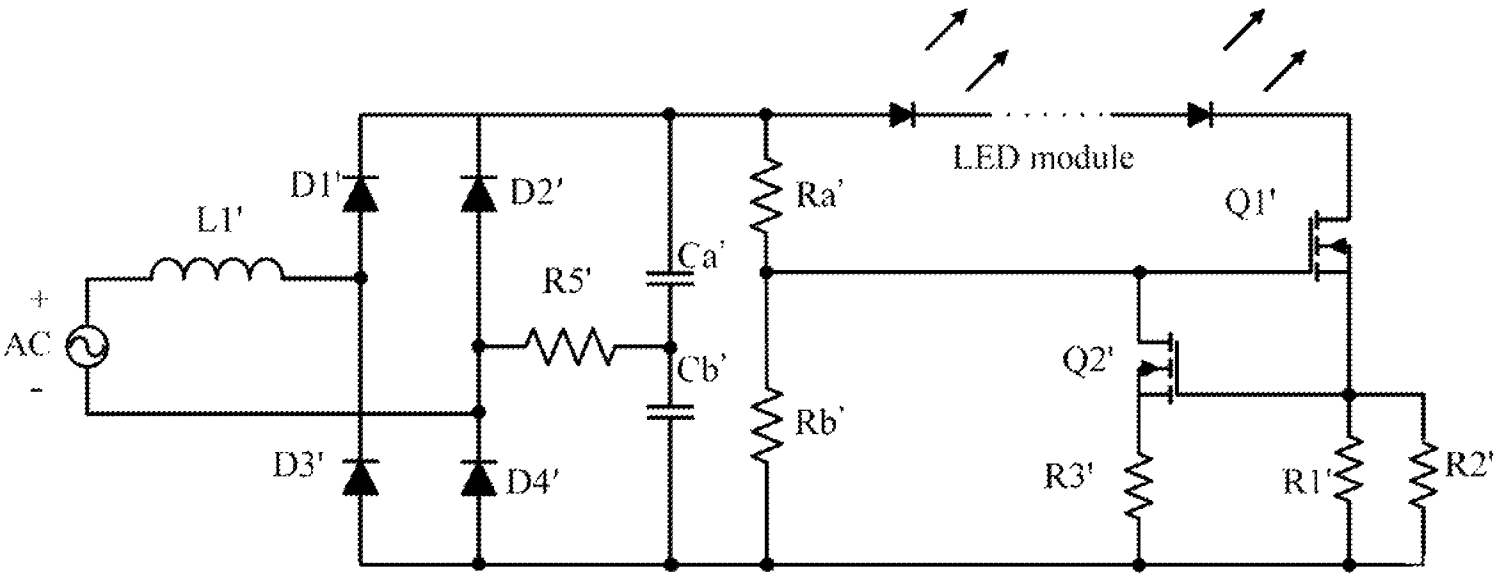
FIG. 5 is a circuit diagram of an LED driver having a compensation capacitor set according to the second preferred embodiment of the present invention.

FIG. 5 is a circuit diagram of an LED driver having a compensation capacitor set according to the second preferred embodiment of the present invention, and it is a structure used in a TRIAC dimming circuit and includes an overtemperature protection function. In FIG. 5, it includes an AC power source AC, a bridge rectifier having rectifying diodes D1'-D4', an LED module having a plurality of LEDs, a compensation capacitor set Ca'+Cb' and a filter inductor L1, wherein each of Ca' and Cb' is a compensation capacitor. The resistor R5' is used to prevent the generation of an inrush current in dimming capacitor when the dimming circuit employs TRIAC to dim. The resistors Ra' and Rb' not only can be used as the voltage dividing resistors to drive the switch Q1', but also can be used as a dummy load to maintain the holding current of the TRIAC. The resistors Ra' and Rb', the switches Q1' and Q2', the resistors R1', R2' and R3' form a current-limiting unit. When the input current has not reached the preset level, the switch Q1' operates in the linear region and is regarded as short-circuited. When the input current reaches the preset level, the voltage across the resistors R1' and R2' makes the switch Q2' enter the saturation region, and then further causes the gate voltage of the switch Q1' to decrease and to make the switch Q1' enter the saturation region so as to accomplish the current-limiting function. Among which, the resistor R2' is a current-limiting resistor, and it is a thermal resistor. When the system temperature is too high, the resistance of the resistor R2' is increased so as to decrease the current-limiting level to lower the power of the whole system.

Figure 6:
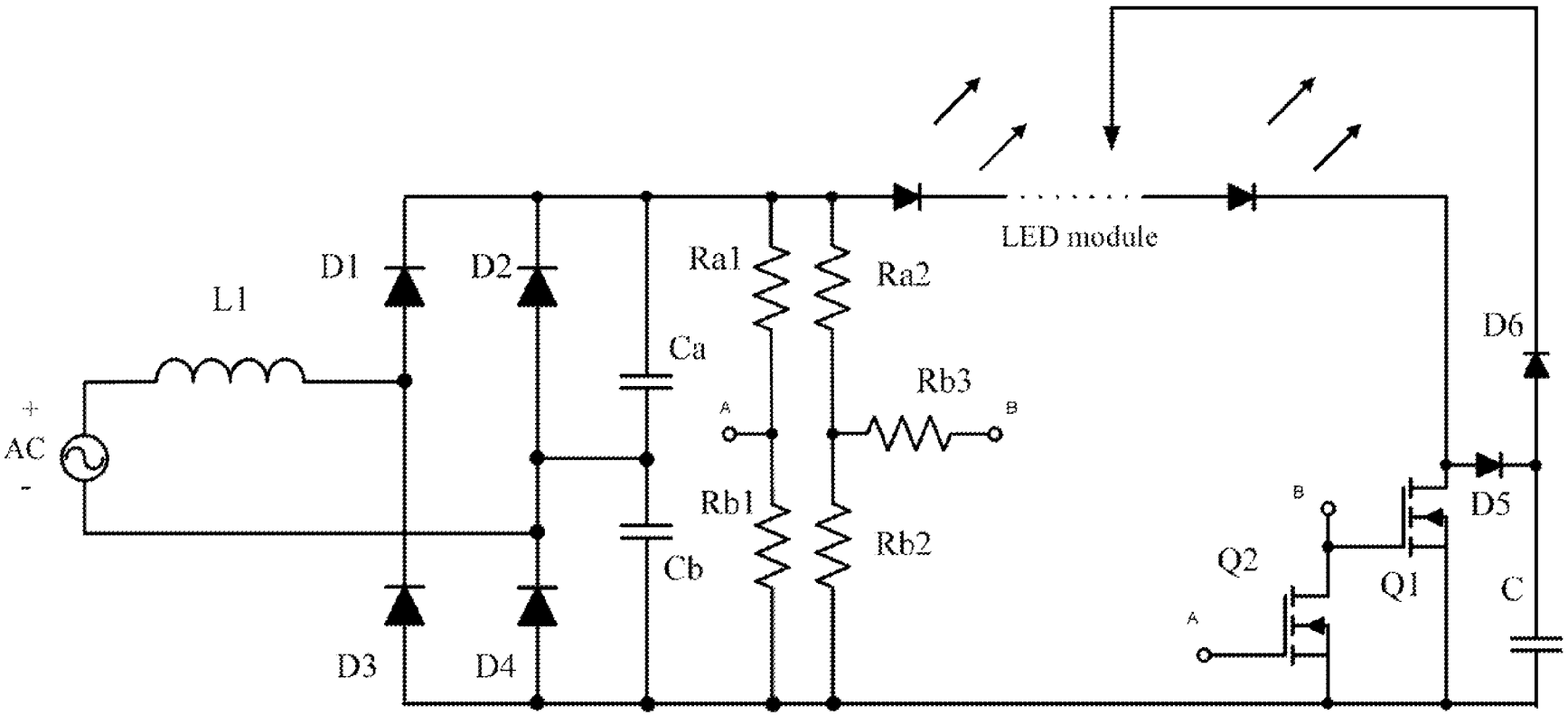
FIG. 6 is a circuit diagram of an LED driver having a compensation capacitor set according to the third preferred embodiment of the present invention.

FIG. 6 is a circuit diagram of an LED driver having a compensation capacitor set according to the third preferred embodiment of the present invention. In FIG. 6, it includes an AC power source AC, a bridge rectifier having rectifying diodes D1-D4, an LED module having a plurality of LEDs, a compensation capacitor set Ca+Cb and a filter inductor L1, wherein each of Ca and Cb is a compensation capacitor. As shown in FIG. 6, it further includes an overvoltage protection and energy recovery circuit. The overvoltage protection and energy recovery circuit includes an energy recovery circuit, a voltage divider, an overvoltage protection circuit and an input voltage detection circuit. And, the overvoltage protection circuit is formed by the resistors Ra1, Ra2, Rb1, Rb2 and Rb3, the switches Q1 and Q2, the diodes D5 and D6, and the capacitor C. Among which, the energy recovery circuit is formed by the capacitor C and the diode D6, the voltage divider is formed by the resistors Ra1 and Ra2 and a first midpoint A, the overvoltage protection circuit is formed by the switches Q1 and Q2, and the diode D5, and the input voltage detection circuit is formed by the resistors Rb1, Rb2 and Rb3 and a second midpoint B. When the input voltage does not exceed a preset level, the divided voltage of the resistors Ra2, Rb2 and Rb3 drives the switch Q1, where the switch Q1 and is regarded as short-circuited at the moment, and the voltage after the bridge rectifier is directly bridged to the LED module. When the input voltage exceeds the preset level, the resistors Ra1 and Rb1 cause the switch Q2 to be turned on, the gate signal of the switch Q1 is dragged to a low level and causes the switch Q1 to be turned off, the input voltage is bridged to the LED module, the diode D5 and the capacitor C at the moment, and the current-limiting effect can be achieved since C has a large impedance. And, when the input voltage decreases to a low level, the energy stored in the capacitor C is then released to the LED module via the diode D6 and the switch Q1. In FIG. 6, the first midpoint A is connected to a control terminal of the switch Q2, and the second midpoint B is connected to a control terminal of the switch Q1 and a first terminal of the switch Q2.

The inductor L1/L1' and the compensation capacitor set Ca+Cb/Ca'+Cb' as shown in FIG. 2 to FIG. 6 are mainly used to decrease the THD and raise the PF so as to meet certain specifications such as IEC61000-3-2. In the low power applications such as candle lamp (less than 5 watt), there is basically no requirement from any specification, and thus the inductor L1/L1' and the compensation capacitor set Ca+Cb/Ca'+Cb' can be omitted due to the considerations of cost and volume.

Figure 7:
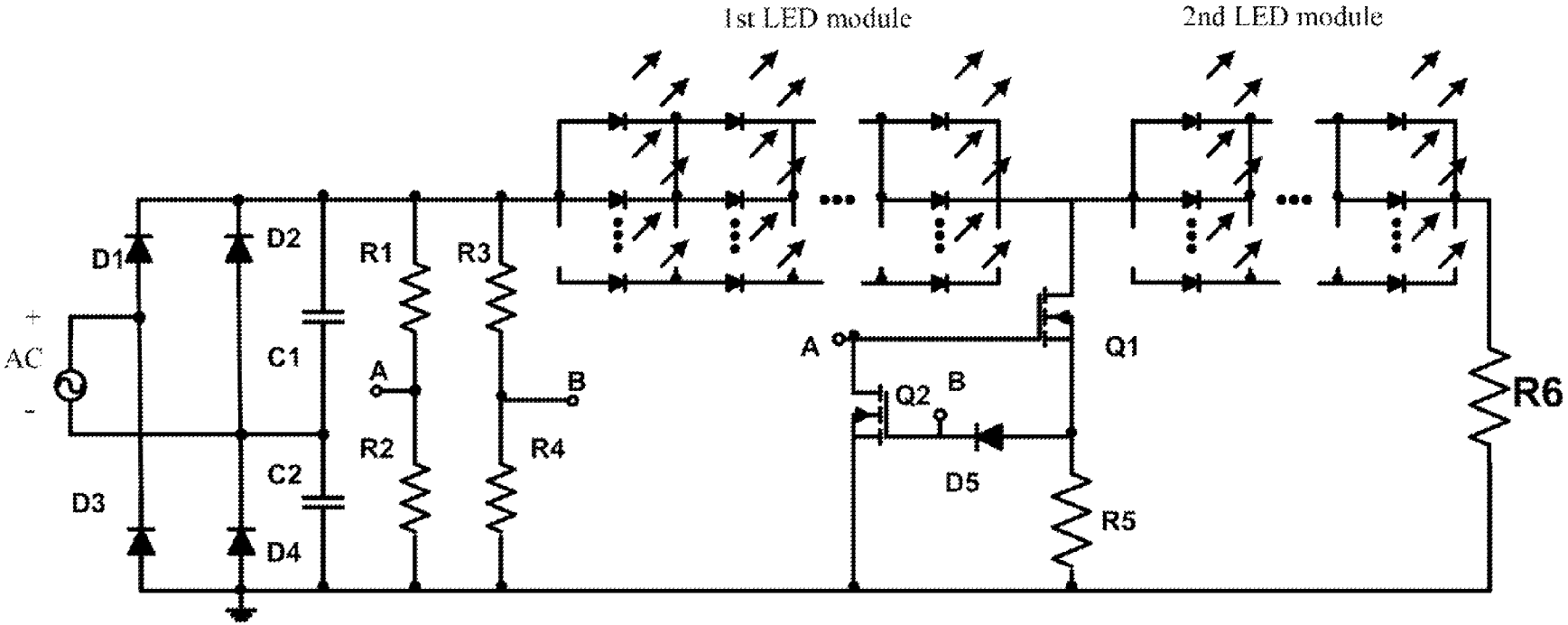
FIG. 7 is a circuit diagram of an LED driver having a compensation capacitor set according to the fourth preferred embodiment of the present invention.

FIG. 7 is a circuit diagram of an LED driver having a compensation capacitor set according to the fourth preferred embodiment of the present invention. In FIG. 7, it includes an AC power source AC, a bridge rectifier having rectifying diodes D1-D4, a first and a second LED modules respectively having a plurality of LEDs, a compensation capacitor set Ca+Cb, wherein each of Ca and Cb is a compensation capacitor, a segmental current-limiting circuit, which has a voltage divider including resistors R1 and R2, and a first midpoint A, an input voltage detection circuit including resistors R3 and R4, and a second midpoint B, a current-limiting circuit and a current-limiting resistor R6. The current-limiting circuit includes the switches Q1 and Q2, the diode D5 and the resistor R5, wherein a control terminal of the switch Q1 and a first terminal of the switch Q2 are commonly electrically connected to the first midpoint A, and a control terminal of the switch Q2 and a cathode of the diode D5 are commonly electrically connected to the second midpoint B.

In the prior art, there are a segmental circuit and a current-limiting circuit, the segmental circuit in the prior art can cause the various segments of the circuit to be sequentially conductible to raise the LED utilization rate, to decrease the THD and to raise the PF, but when the input voltage is too high, the overcurrent problem will be generated. The current-limiting circuit in the prior art can prevent the current flowing through the LED from being too high. Right now, there is no known prior art to combine these two together, and in addition, the circuit will be too complex when these two are combined together. The present invention integrates the characteristics of the segmental circuit and the current-limiting circuit into one as shown in the circuit of FIG. 7, and uses the diode D5 to generate the current-limiting function first and then the segmental conduction function. The operational principles of the circuit shown in FIG. 7 are described briefly as follows. When the input voltage is increased gradually, the voltage at point A is increased to cause the switch Q1 to be turned on, if the input voltage is larger than the conduction voltage of the first LED module at the moment, the current begins to flow, and the current path is: the input voltage→the bridge rectifier→the first LED module→the switch Q1→the resistor R5. When the current flowing through R5 is increased following the increase of the input voltage, the voltage at point B is increased gradually also. When the voltage at point B is increased, this causes the switch Q2 to enter the saturation region (the switch Q2 is not in the open-circuited status any more but is similar to a variable resistor at the moment), the voltage at point A will drop, and it will cause the switch Q1 to enter the saturation region as well, thus the current flowing through the switch Q1 will be clamped so as to achieve the current-limiting effect. When the input voltage is raised continuously such that the voltage at point B is higher than (the cross voltage of R5—the cross voltage of D5), the voltage at point B is predominated by the voltage dividing resistors R3 and R4 at the moment, and is increased following the increase of the input voltage so as to cause the switch Q2 to be turned on to drag the voltage at point A to a low level such that the switch Q1 cuts off, and the driver enters a segmental conduction status at the moment. The first LED module and the second LED module are conductible in series, and the current path at the moment is: the input voltage→the bridge rectifier→the first LED module→the second LED module. Following the decrease of the input voltage, the switch Q1 will enter the saturation region again to cause the first LED module and the second LED module to be released from the turn-on in series, and to be current-limiting alone respectively, when the input voltage is decreased continuously, the current-limiting function will be terminated, and then the driver engages in this process repeatedly.

Figure 8:
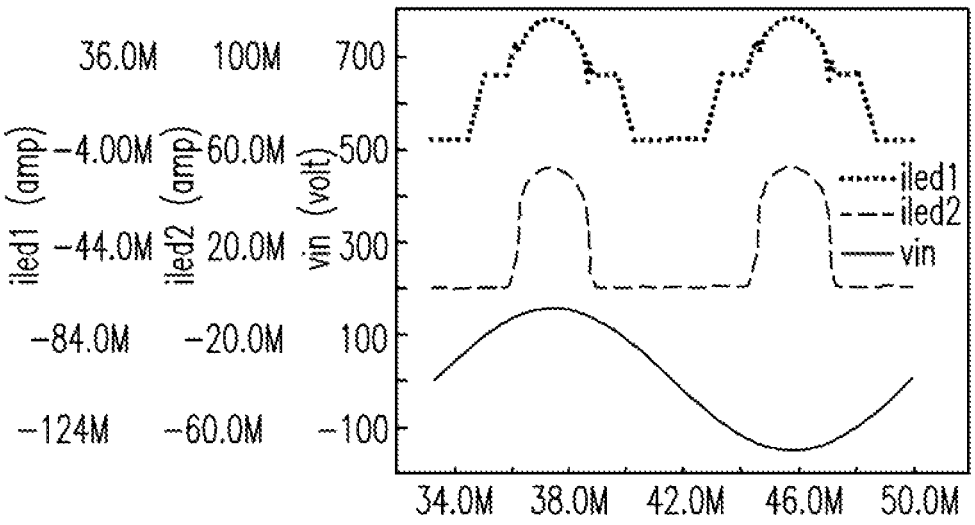
FIG. 8 shows the waveform diagram of the current flowing through the first LED module, the current flowing through the second LED module and the input voltage versus time of the LED driver having a compensation capacitor set according to the fourth preferred embodiment of the present invention as shown in FIG. 7.

FIG. 8 shows the waveform diagram of the current flowing through the first LED module iled1 (amp), the current flowing through the second LED module iled2 (amp) and the input voltage (volt) versus time (sec) of the LED driver having a compensation capacitor set Ca+Cb according to the fourth preferred embodiment of the present invention as shown in FIG. 7.

Figure 9:
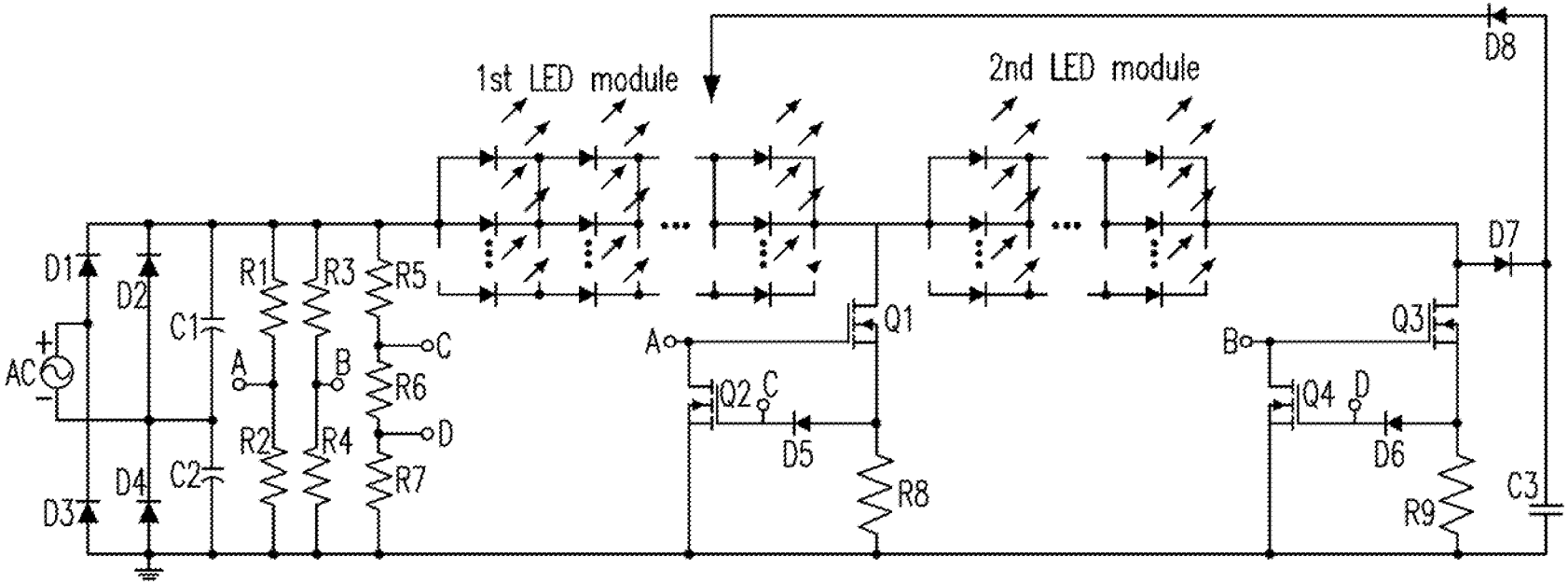
FIG. 9 is a circuit diagram of an LED driver having a compensation capacitor set according to the fifth preferred embodiment of the present invention.

FIG. 9 is a circuit diagram of an LED driver having a compensation capacitor set according to the fifth preferred embodiment of the present invention. In FIG. 9, it includes an AC power source AC, a bridge rectifier having rectifying diodes D1-D4, a first and a second LED modules respectively having a plurality of LEDs, a compensation capacitor set C1+C2, wherein each of C1 and C2 is a compensation capacitor, an overvoltage protection and energy recovery circuit, and a segmental current-limiting circuit. The overvoltage protection and energy recovery circuit includes an energy recovery circuit and an overvoltage protection circuit. The segmental current-limiting circuit includes a first voltage divider, a first current-limiting circuit and an input voltage detection circuit, wherein the first voltage divider includes resistors R1 and R2, and a first midpoint A, the first current-limiting circuit includes switches Q1 and Q2, a diode D5 and a resistor R8, the input voltage detection circuit includes resistors R5, R6 and R7, and a third midpoint C and a fourth midpoint D. Among which, a control terminal of the switch Q1 and a first terminal of the switch Q2 are commonly electrically connected to the first midpoint A, and a control terminal of the switch Q2 and a cathode of the diode D5 are commonly electrically connected to the third midpoint C. The energy recovery circuit has a capacitor C3 and a diode D8, the overvoltage protection circuit includes a second voltage divider and a second current-limiting circuit. The second voltage divider includes resistors R3 and R4, and a second midpoint B. The second current-limiting circuit includes switches Q3 and Q4, a diode D6 and a resistor R9, a control terminal of the switch Q3 and a first terminal of the switch Q4 are commonly electrically connected to the second midpoint B, and a control terminal of the switch Q4 and a cathode of the diode D6 are commonly electrically connected to the fourth midpoint D. The voltage at the first midpoint A determines when the switch Q1 is turned on, the voltage at the second midpoint B determines when the switch Q3 is turned on, the voltage at the third midpoint C determines when the driver switches to the segmental current-limiting circuit, and the voltage at the fourth midpoint D determines when the driver switches to the overvoltage protection circuit.

The operational principles of the circuit shown in FIG. 9 are described as follows. The first LED module is conductible and the second LED module is turned off→The first LED module is current-limiting and the second LED module is turned off→The first and the second LED modules are conductible in series→The first LED and the second LED modules are conductible and current-limiting. And, if the input voltage is too high, the operations become: The first LED module is conductible and the second LED module is turned off→The first LED module is current-limiting and the second LED module is turned off→The first and the second LED modules are conductible in series→The first LED and the second LED modules are conductible in series and current-limiting→The first and the second LED modules are conductible in series via the diode D7 and the capacitor C3 to further achieve the current-limiting and the watt-limiting. And, the energy stored in the capacitor C3 will be released to the LED via the diode D8 at the beginning of the next cycle.

Figure 10A:
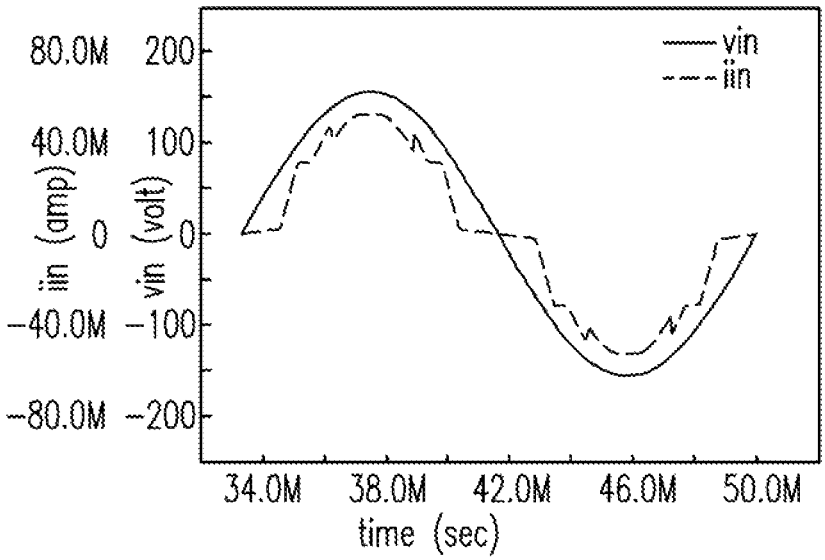
FIG. 10(*a*) shows the waveform diagram of the input current and the input voltage versus time when the input voltage is normal of the LED driver having a compensation capacitor set according to the fourth preferred embodiment of the present invention as shown in FIG. 9.
Figure 10B:
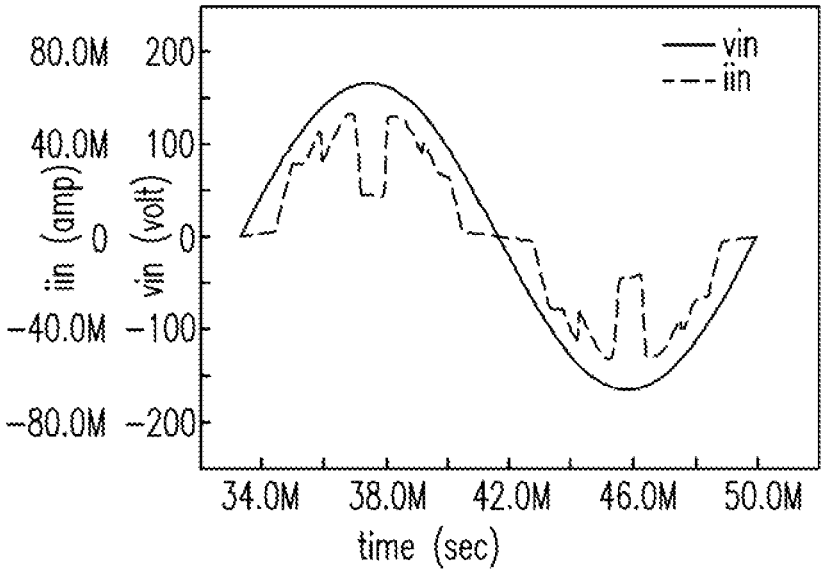

FIG. 10(*a*) shows the waveform diagram of the input current iin (amp) and the input voltage vin (volt) versus time (sec) when the input voltage is normal of the LED driver having a compensation capacitor set C1+C2 according to the fourth preferred embodiment of the present invention as shown in FIG. 9. FIG. 10 (*b*) shows the waveform diagram of the input current iin (amp) and the input voltage vin (volt) versus time (sec) when the input voltage is too high of the LED driver having a compensation capacitor set C1+C2 according to the fourth preferred embodiment of the present invention as shown in FIG. 9. In the waveforms of FIG. 10(*a*), it is noted that there are two current-limiting platforms. In the waveforms of FIG. 10(*b*), when the input voltage is too high, the overvoltage protection function is started to limit the current value at the peak voltage.

Embodiments

1. A light emitting diode (LED) driver receiving an input voltage, driving a first and a second LED modules, and comprising:

a compensation capacitor set including a first and a second capacitors electrically connected to each other in series, wherein the first capacitor is electrically connected to the first and the second LED modules, the second capacitor is grounded, and the compensation capacitor set provides a compensation voltage to the first and the second LED modules when an instantaneous voltage value of the input voltage is lower than an LED conduction voltage such that the first and the second LED modules are conductible;

an overvoltage protection and energy recovery circuit, including:

an energy recovery circuit, including:

a third capacitor having a first and a second terminals; and a first diode having an anode and a cathode, wherein the anode of the first diode is electrically connected to the first terminal of the third capacitor, the second terminal of the third capacitor is grounded, the cathode of the first diode is electrically connected to the first and the second LED modules, and a stored energy in the third capacitor is released to the first and the second LED modules when a cross voltage between the first and the second terminals of the third capacitor is larger than a cross voltage of the compensation capacitor set; and a segmental current-limiting circuit, including:

a first voltage divider electrically connected to the compensation capacitor set in parallel and having a first midpoint;

a first current limiting circuit, including:

a second diode having an anode and a cathode;

a first resistor having a first and a second terminals, wherein the first terminal of the first resistor is electrically connected to the anode of the second diode, and the second terminal of the first resistor is grounded;

a first transistor having a first terminal, a second terminal and a control terminal, wherein the first terminal of the first transistor is electrically connected to the first and the second LED modules, the second terminal of the first transistor is electrically connected to the first terminal of the first resistor, and the control terminal of the first transistor is electrically connected to the first midpoint of the first voltage divider; and a second transistor having a first terminal, a second terminal and a control terminal, wherein the first terminal of the second transistor is electrically connected to the second terminal of the first transistor, the second terminal of the second transistor is grounded, and the control terminal of the second transistor is electrically connected to the cathode of the second diode; and an input voltage detection circuit electrically connected to the compensation capacitor set in parallel and including a second midpoint electrically connected to the control terminal of the second transistor, wherein the second midpoint has a voltage value used to determine whether the LED driver enters a segmental conduction mode.

2. A driver according to Embodiment 1, wherein the overvoltage protection and energy recovery circuit further includes an overvoltage protection circuit, including:

a second voltage divider electrically connected to the compensation capacitor set in parallel and having a third midpoint;

a second current limiting circuit, including:

a third diode having an anode and a cathode;

a second resistor having a first and a second terminals, wherein the first terminal of the second resistor is electrically connected to the anode of the third diode, and the second terminal of the second resistor is grounded;

a third transistor having a first terminal, a second terminal and a control terminal, wherein the first terminal of the third transistor is electrically connected to the second LED module, the second terminal of the third transistor is electrically connected to the first terminal of the second resistor, and the control terminal of the third transistor is electrically connected to the third midpoint of the second voltage divider;

a fourth transistor having a first terminal, a second terminal and a control terminal, wherein the input voltage detection circuit further includes a fourth midpoint, the first terminal of the fourth transistor is electrically connected to the control terminal of the third transistor, the second terminal of the fourth transistor is grounded, the control terminal of the fourth transistor is electrically connected to the cathode of the third diode and the fourth midpoint of the input voltage detection circuit, and a voltage value of the fourth midpoint is used to determine whether the LED driver switches into an overvoltage protection mode; and a fourth diode having an anode and a cathode, wherein the anode of the fourth diode is electrically connected to the first terminal of the third transistor and the cathode of the fourth diode is electrically connected to the first terminal of the third capacitor.

3. A driver according to Embodiment 1 or 2, further comprising an AC input power source and a rectifier having a first and a second input terminals and a first and a second output terminals, wherein each of the first and the second capacitors has a first and a second terminals, the rectifier is electrically connected to the AC input power source at the first and the second input terminals, the second input terminal of the rectifier is electrically connected to the second terminal of the first capacitor and the first terminal of the second capacitor, the first output terminal of the rectifier is electrically connected to the first terminal of the first capacitor, and the second output terminal of the rectifier is grounded and is electrically connected to the second terminal of the second capacitor.

4. A driver according to any one of the above-mentioned Embodiments, wherein the first voltage divider further comprises a third and a fourth resistors electrically connected to the first midpoint, the second voltage divider further comprises a fifth and a sixth resistors electrically connected to the third midpoint, the input voltage detection circuit further comprises a seventh to a ninth resistors, the seventh and the eighth resistors are electrically connected to the second midpoint, the eighth and the ninth resistors are electrically connected to the fourth midpoint, the driver enters the segmental conduction mode when one of the input voltage and a voltage value of the second midpoint is not larger than a predetermined value, the driver enters the overvoltage protection mode when one of the input voltage and a voltage value of the fourth midpoint is larger than the predetermined value, and when the cross voltage of the third capacitor is larger than the cross voltage of the compensation capacitor set, the stored energy of the third capacitor is released to the first and the second LED modules via the third diode.

5. A light emitting diode (LED) driver receiving an input voltage, driving a first and a second LED modules, and comprising:

a compensation capacitor set including a first and a second capacitors electrically connected to each other in series, wherein the first capacitor is electrically connected to the first and the second LED modules, the second capacitor is grounded, and the compensation capacitor set provides a compensation voltage to the first and the second LED modules when an instantaneous voltage value of the input voltage is lower than an LED conduction voltage such that the first and the second LED modules are conductible; and a segmental current-limiting circuit, including:

a voltage divider electrically connected to the compensation capacitor set in parallel and having a first midpoint;

a current limiting circuit, including:

a first diode having an anode and a cathode;

a first resistor having a first and a second terminals, wherein the first terminal of the first resistor is electrically connected to the anode of the first diode, and the second terminal of the first resistor is grounded;

a first transistor having a first terminal, a second terminal and a control terminal, wherein the first terminal of the first transistor is electrically connected to the first and the second LED modules, the second terminal of the first transistor is electrically connected to the first terminal of the first resistor, and the control terminal of the first transistor is electrically connected to the first midpoint of the voltage divider; and a second transistor having a first terminal, a second terminal and a control terminal, wherein the first terminal of the second transistor is electrically connected to the second terminal of the first transistor, the second terminal of the second transistor is grounded, and the control terminal of the second transistor is electrically connected to the cathode of the first diode; and an input voltage detection circuit electrically connected to the compensation capacitor set in parallel and including a second midpoint, wherein the second midpoint is electrically connected to the control terminal of the second transistor, and a voltage value of the second midpoint is used to determine whether the LED driver switches into an overvoltage protection mode.

6. A driver according to Embodiment 5, further comprising an AC input power source and a rectifier having a first and a second input terminals and a first and a second output terminals, wherein each of the first and the second capacitors has a first and a second terminals, the rectifier is electrically connected to the AC input power source at the first and the second input terminals, the second input terminal of the rectifier is electrically connected to the second terminal of the first capacitor and the first terminal of the second capacitor, the first output terminal of the rectifier is electrically connected to the first terminal of the first capacitor, and the second output terminal of the rectifier is grounded and is electrically connected to the second terminal of the second capacitor.

7. A driver according to Embodiment 5 or 6, wherein the voltage divider further comprises a second and a third resistor electrically connected to each other at the first midpoint in series, and the input voltage detection circuit further comprises a fourth and a fifth resistors electrically connected to each other at the second midpoint in series.

8. A light emitting diode (LED) driver receiving an input voltage, driving an LED, and comprising:

a compensation capacitor set including a first and a second capacitors electrically connected to each other in series, wherein the first capacitor is electrically connected to the LED, the second capacitor is grounded, and the compensation capacitor set provides a compensation voltage to the LED when an instantaneous voltage value of the input voltage is lower than an LED conduction voltage such that the LED is conductible.

9. A driver according to Embodiment 8, further comprising an AC input power source, an inductor having a first and a second terminals, and a rectifier having a first and a second input terminals and a first and a second output terminals, wherein the LED includes an anode and a cathode, the AC input power source is electrically connected to the first terminal of the inductor and the second input terminal of the rectifier, the second terminal of the inductor is electrically connected to the first input terminal of the rectifier, the second input terminal of the rectifier is electrically connected to the second terminal of the first capacitor and the first terminal of the second capacitor, the first output terminal of the rectifier is electrically connected to the first terminal of the first capacitor and the anode of the LED, and the second output terminal of the rectifier is grounded and electrically connected to the second terminal of the second capacitor and the cathode of the LED.

10. A driver according to Embodiment 8 or 9, further comprising an overvoltage protection and energy recovery circuit, including:

an energy recovery circuit, including:

a third capacitor having a first and a second terminals; and a first diode having an anode and a cathode, wherein the anode of the first diode is electrically connected to the first terminal of the third capacitor, the second terminal of the third capacitor is grounded, the cathode of the first diode is electrically connected to the LED, and a stored energy in the third capacitor is released to the LED when a cross voltage between the first and the second terminals of the third capacitor is larger than a cross voltage of the compensation capacitor set;

a voltage divider electrically connected to the compensation capacitor set in parallel and having a first midpoint;

an overvoltage protection circuit, including:

a first transistor having a first terminal, a second terminal and a control terminal, wherein the first terminal of the first transistor is electrically connected to the LED, and the second terminal of the first transistor is grounded; and a second transistor having a first terminal, a second terminal and a control terminal, wherein the first terminal of the second transistor is electrically connected to the control terminal of the first transistor and the first midpoint, and the second terminal of the second transistor is grounded; and an input voltage detection circuit electrically connected to the voltage divider in parallel and including a second midpoint electrically connected to the control terminal of the second transistor.

11. A driver according to any one of the above-mentioned Embodiments, further comprising an AC input power source, an inductor having a first and a second terminals, and a rectifier having a first and a second input terminals and a first and a second output terminals, wherein the LED includes an anode and a cathode, the overvoltage protection circuit further includes a second diode having an anode and a cathode, the anode of the second diode is electrically connected to the first terminal of the first transistor, and the cathode of the second diode is electrically connected to the first terminal of the third capacitor.

12. A driver according to any one of the above-mentioned Embodiments, wherein the voltage divider further includes a first to a third resistors, each of which has a first and a second terminals, the first terminal of the first resistor is electrically connected to the anode of the LED, the first terminal of the second resistor is electrically connected to the second terminal of the first resistor and the first terminal of the third resistor, the second terminal of the second resistor is grounded, the second terminal of the third resistor is electrically connected to the first midpoint, the input voltage detection circuit further comprises a fourth and a fifth resistors, each of which has a first and a second terminals, the second terminal of the fourth resistor is electrically connected to the first terminal of the fifth resistor at the second midpoint, the second terminal of the fifth resistor is grounded, the AC input power source is electrically connected to the first terminal of the inductor and the second input terminal of the rectifier, the second terminal of the inductor is electrically connected to the first input terminal of the rectifier, each of the first and the second capacitors has a first and a second terminals, the second input terminal of the rectifier is electrically connected to the second terminal of the first capacitor and the first terminal of the second capacitor, the first output terminal of the rectifier is electrically connected to the first terminal of the first capacitor and the respective first terminals of the first and the fourth resistors, the second output terminal of the rectifier is grounded and electrically connected to the second terminal of the second capacitor.

13. A driver according to any one of the above-mentioned Embodiments, further comprising:

a current-limiting circuit, including:

a voltage divider electrically connected to the compensation capacitor set in parallel and having a first midpoint;

an overtemperature protection circuit, including:

a first transistor having a first terminal, a second terminal and a control terminal, wherein the first terminal of the first transistor is electrically connected to the LED; and a second transistor having a first terminal, a second terminal and a control terminal, wherein the first terminal of the second transistor is electrically connected to the control terminal of the first transistor and the first midpoint; and a current-limiting resistor having a first and a second terminals, wherein the first terminal of the current-limiting resistor is electrically connected to the second terminal of the first transistor and the control terminal of the second transistor, and the second terminal of the current-limiting resistor is grounded.

14. A driver according to any one of the above-mentioned Embodiments, further comprising an AC input power source, an inductor having a first and a second terminals, and a rectifier having a first and a second input terminals and a first and a second output terminals, wherein the LED includes an anode and a cathode, the overtemperature protection circuit further includes a first and a second resistors, each of which has a first and a second terminals, the first terminal of the first resistor is electrically connected to the first terminal of the current-limiting resistor, the second terminal of the first resistor is grounded, the first terminal of the second resistor is electrically connected to the second terminal of the second transistor, and the second terminal of the second resistor is grounded.

15. A driver according to any one of the above-mentioned Embodiments, wherein each of the first and the second capacitors has a first and a second terminals, the voltage divider further includes a third and a fourth resistors, each of which has a first and a second terminals, the compensation capacitor set further includes a fifth resistor having a first and a second terminals, the first terminal of the third resistor is electrically connected to the anode of the LED and the first terminal of the first capacitor, the cathode of the LED is electrically connected to the first terminal of the first transistor, the second terminal of the third resistor is electrically connected to the first terminal of the fourth resistor, the second terminal of the fourth resistor is grounded, the AC input power source is electrically connected to the first terminal of the inductor and the second input terminal of the rectifier, the second terminal of the inductor is electrically connected to the first input terminal of the rectifier, the second input terminal of the rectifier is electrically connected to the first terminal of the fifth resistor, the second terminal of the fifth resistor is electrically connected to the second terminal of the first capacitor and the first terminal of the second capacitor, the first output terminal of the rectifier is electrically connected to the first terminal of the first capacitor, and the second output terminal of the rectifier is grounded and electrically connected to the second terminal of the second capacitor.

According to the aforementioned descriptions, the present invention discloses an LED driver having the relatively higher PF, the relatively lower THD and the relatively higher efficiency to further save energy and exhibit maximum efficiency so as to possess non-obviousness and novelty.

While the invention has been described in terms of what is presently considered to be the most practical and preferred embodiments, it is to be understood that the invention needs not be limited to the disclosed embodiments. Therefore, it is intended to cover various modifications and similar configuration included within the spirit and scope of the appended claims, which are to be accorded with the broadest interpretation so as to encompass all such modifications and similar structures.

What is claimed is:

1. A light emitting diode (LED) driver receiving an input voltage, driving a first and a second LED modules, and comprising:

a compensation capacitor set including a first and a second capacitors electrically connected to each other in series, wherein the first capacitor is electrically connected to the first and the second LED modules, the second capacitor is grounded, and the compensation capacitor set provides a compensation voltage to the first and the second LED modules when an instantaneous voltage value of the input voltage is lower than an LED conduction voltage such that the first and the second LED modules are conductible;

an overvoltage protection and energy recovery circuit, including:

an energy recovery circuit, including:

a third capacitor having a first and a second terminals; and a first diode having an anode and a cathode, wherein the anode of the first diode is electrically connected to the first terminal of the third capacitor, the second terminal of the third capacitor is grounded, the cathode of the first diode is electrically connected to the first and the second LED modules, and a stored energy in the third capacitor is released to the first and the second LED modules when a cross voltage between the first and the second terminals of the third capacitor is larger than a cross voltage of the compensation capacitor set; and a segmental current-limiting circuit, including:

a first voltage divider electrically connected to the compensation capacitor set in parallel and having a first midpoint;

a first current limiting circuit, including:

a second diode having an anode and a cathode;

a first resistor having a first and a second terminals, wherein the first terminal of the first resistor is electrically connected to the anode of the second diode, and the second terminal of the first resistor is grounded;

a first transistor having a first terminal, a second terminal and a control terminal, wherein the first terminal of the first transistor is electrically connected to the first and the second LED modules, the second terminal of the first transistor is electrically connected to the first terminal of the first resistor, and the control terminal of the first transistor is electrically connected to the first midpoint of the first voltage divider; and a second transistor having a first terminal, a second terminal and a control terminal, wherein the first terminal of the second transistor is electrically connected to the second terminal of the first transistor, the second terminal of the second transistor is grounded, and the control terminal of the second transistor is electrically connected to the cathode of the second diode; and an input voltage detection circuit electrically connected to the compensation capacitor set in parallel and including a second midpoint electrically connected to the control terminal of the second transistor, wherein the second midpoint has a voltage value used to determine whether the LED driver enters a segmental conduction mode.

2. A driver according to claim 1, wherein the overvoltage protection and energy recovery circuit further includes an overvoltage protection circuit, including:

a second voltage divider electrically connected to the compensation capacitor set in parallel and having a third midpoint;

a second current limiting circuit, including:

a third diode having an anode and a cathode;

a second resistor having a first and a second terminals, wherein the first terminal of the second resistor is electrically connected to the anode of the third diode, and the second terminal of the second resistor is grounded;

a third transistor having a first terminal, a second terminal and a control terminal, wherein the first terminal of the third transistor is electrically connected to the second LED module, the second terminal of the third transistor is electrically connected to the first terminal of the second resistor, and the control terminal of the third transistor is electrically connected to the third midpoint of the second voltage divider;

a fourth transistor having a first terminal, a second terminal and a control terminal, wherein the input voltage detection circuit further includes a fourth midpoint, the first terminal of the fourth transistor is electrically connected to the control terminal of the third transistor, the second terminal of the fourth transistor is grounded, the control terminal of the fourth transistor is electrically connected to the cathode of the third diode and the fourth midpoint of the input voltage detection circuit, and a voltage value of the fourth midpoint is used to determine whether the LED driver switches into an overvoltage protection mode; and a fourth diode having an anode and a cathode, wherein the anode of the fourth diode is electrically connected to the first terminal of the third transistor and the cathode of the fourth diode is electrically connected to the first terminal of the third capacitor.

3. A driver according to claim 2, further comprising an AC input power source and a rectifier having a first and a second input terminals and a first and a second output terminals, wherein each of the first and the second capacitors has a first and a second terminals, the rectifier is electrically connected to the AC input power source at the first and the second input terminals, the second input terminal of the rectifier is electrically connected to the second terminal of the first capacitor and the first terminal of the second capacitor, the first output terminal of the rectifier is electrically connected to the first terminal of the first capacitor, and the second output terminal of the rectifier is grounded and is electrically connected to the second terminal of the second capacitor.

4. A driver according to claim 3, wherein the first voltage divider further comprises a third and a fourth resistors electrically connected to the first midpoint, the second voltage divider further comprises a fifth and a sixth resistors electrically connected to the third midpoint, the input voltage detection circuit further comprises a seventh to a ninth resistors, the seventh and the eighth resistors are electrically connected to the second midpoint, the eighth and the ninth resistors are electrically connected to the fourth midpoint, the driver enters the segmental conduction mode when one of the input voltage and a voltage value of the second midpoint is not larger than a predetermined value, the driver enters the overvoltage protection mode when one of the input voltage and a voltage value of the fourth midpoint is larger than the predetermined value, and when the cross voltage of the third capacitor is larger than the cross voltage of the compensation capacitor set, the stored energy of the third capacitor is released to the first and the second LED modules via the third diode.

5. A light emitting diode (LED) driver receiving an input voltage, driving an LED, and comprising:

a compensation capacitor set including a first and a second capacitors electrically connected to each other in series, wherein the first capacitor is electrically connected to the LED, the second capacitor is grounded, and the compensation capacitor set provides a compensation voltage to the LED when an instantaneous voltage value of the input voltage is lower than an LED conduction voltage such that the LED is conductible.

6. A driver according to claim 5, further comprising an AC input power source, an inductor having a first and a second terminals, and a rectifier having a first and a second input terminals and a first and a second output terminals, wherein the LED includes an anode and a cathode, the AC input power source is electrically connected to the first terminal of the inductor and the second input terminal of the rectifier, the second terminal of the inductor is electrically connected to the first input terminal of the rectifier, the second input terminal of the rectifier is electrically connected to the second terminal of the first capacitor and the first terminal of the second capacitor, the first output terminal of the rectifier is electrically connected to the first terminal of the first capacitor and the anode of the LED, and the second output terminal of the rectifier is grounded and electrically connected to the second terminal of the second capacitor and the cathode of the LED.

7. A driver according to claim 5, further comprising an overvoltage protection and energy recovery circuit, including:

an energy recovery circuit, including:

a third capacitor having a first and a second terminals; and a first diode having an anode and a cathode, wherein the anode of the first diode is electrically connected to the first terminal of the third capacitor, the second terminal of the third capacitor is grounded, the cathode of the first diode is electrically connected to the LED, and a stored energy in the third capacitor is released to the LED when a cross voltage between the first and the second terminals of the third capacitor is larger than a cross voltage of the compensation capacitor set;

a voltage divider electrically connected to the compensation capacitor set in parallel and having a first midpoint;

an overvoltage protection circuit, including:

a first transistor having a first terminal, a second terminal and a control terminal, wherein the first terminal of the first transistor is electrically connected to the LED, and the second terminal of the first transistor is grounded; and a second transistor having a first terminal, a second terminal and a control terminal, wherein the first terminal of the second transistor is electrically connected to the control terminal of the first transistor and the first midpoint, and the second terminal of the second transistor is grounded; and an input voltage detection circuit electrically connected to the voltage divider in parallel and including a second midpoint electrically connected to the control terminal of the second transistor.

8. A driver according to claim 7, further comprising an AC input power source, an inductor having a first and a second terminals, and a rectifier having a first and a second input terminals and a first and a second output terminals, wherein the LED includes an anode and a cathode, the overvoltage protection circuit further includes a second diode having an anode and a cathode, the anode of the second diode is electrically connected to the first terminal of the first transistor, and the cathode of the second diode is electrically connected to the first terminal of the third capacitor.

9. A driver according to claim 8, wherein the voltage divider further includes a first to a third resistors, each of which has a first and a second terminals, the first terminal of the first resistor is electrically connected to the anode of the LED, the first terminal of the second resistor is electrically connected to the second terminal of the first resistor and the first terminal of the third resistor, the second terminal of the second resistor is grounded, the second terminal of the third resistor is electrically connected to the first midpoint, the input voltage detection circuit further comprises a fourth and a fifth resistors, each of which has a first and a second terminals, the second terminal of the fourth resistor is electrically connected to the first terminal of the fifth resistor at the second midpoint, the second terminal of the fifth resistor is grounded, the AC input power source is electrically connected to the first terminal of the inductor and the second input terminal of the rectifier, the second terminal of the inductor is electrically connected to the first input terminal of the rectifier, each of the first and the second capacitors has a first and a second terminals, the second input terminal of the rectifier is electrically connected to the second terminal of the first capacitor and the first terminal of the second capacitor, the first output terminal of the rectifier is electrically connected to the first terminal of the first capacitor and the respective first terminals of the first and the fourth resistors, the second output terminal of the rectifier is grounded and electrically connected to the second terminal of the second capacitor.

10. A driver according to claim 5, further comprising:

a current-limiting circuit, including:

a voltage divider electrically connected to the compensation capacitor set in parallel and having a first midpoint;

an overtemperature protection circuit, including:

a first transistor having a first terminal, a second terminal and a control terminal, wherein the first terminal of the first transistor is electrically connected to the LED; and a second transistor having a first terminal, a second terminal and a control terminal, wherein the first terminal of the second transistor is electrically connected to the control terminal of the first transistor and the first midpoint; and a current-limiting resistor having a first and a second terminals, wherein the first terminal of the current-limiting resistor is electrically connected to the second terminal of the first transistor and the control terminal of the second transistor, and the second terminal of the current-limiting resistor is grounded.

11. A driver according to claim 10, further comprising an AC input power source, an inductor having a first and a second terminals, and a rectifier having a first and a second input terminals and a first and a second output terminals, wherein the LED includes an anode and a cathode, the over-temperature protection circuit further includes a first and a second resistors, each of which has a first and a second terminals, the first terminal of the first resistor is electrically connected to the first terminal of the current-limiting resistor, the second terminal of the first resistor is grounded, the first terminal of the second resistor is electrically connected to the second terminal of the second transistor, and the second terminal of the second resistor is grounded.

12. A driver according to claim 11, wherein each of the first and the second capacitors has a first and a second terminals, the voltage divider further includes a third and a fourth resistors, each of which has a first and a second terminals, the compensation capacitor set further includes a fifth resistor having a first and a second terminals, the first terminal of the third resistor is electrically connected to the anode of the LED and the first terminal of the first capacitor, the cathode of the LED is electrically connected to the first terminal of the first transistor, the second terminal of the third resistor is electrically connected to the first terminal of the fourth resistor, the second terminal of the fourth resistor is grounded, the AC input power source is electrically connected to the first terminal of the inductor and the second input terminal of the rectifier, the second terminal of the inductor is electrically connected to the first input terminal of the rectifier, the second input terminal of the rectifier is electrically connected to the first terminal of the fifth resistor, the second terminal of the fifth resistor is electrically connected to the second terminal of the first capacitor and the first terminal of the second capacitor, the first output terminal of the rectifier is electrically connected to the first terminal of the first capacitor, and the second output terminal of the rectifier is grounded and electrically connected to the second terminal of the second capacitorê.

* * * * *